US005924966A

United States Patent [19]

Havlovic

[11] Patent Number: 5,924,966

[45] Date of Patent: Jul. 20, 1999

[54] APPARATUS FOR EXERCISING TRICEPS MUSCLES

[76] Inventor: David A. Havlovic, 5598 E. Kemper Rd., Cincinnati, Ohio 45241

[21] Appl. No.: 09/005,518

[22] Filed: Jan. 12, 1998

[51] Int. Cl.[6] ..... A63B 21/04

[52] U.S. Cl. ..... 482/129; 482/904

[58] Field of Search ..... 482/99, 102, 103, 482/129, 904, 121; 254/39

[56] References Cited

U.S. PATENT DOCUMENTS

| | | | |
|---|---|---|---|
| 1,762,095 | 6/1930 | Houston | 254/39 |
| 4,072,308 | 2/1978 | Applegate | 482/904 X |
| 5,415,608 | 5/1995 | Bode et al. | 482/904 X |
| 5,601,518 | 2/1997 | Weintrab | 482/129 |
| 5,634,873 | 6/1997 | Carlstrom | 482/904 X |

FOREIGN PATENT DOCUMENTS

| | | | |
|---|---|---|---|
| 1655522 | 6/1991 | U.S.S.R. | 482/129 |
| 2257921 | 1/1993 | United Kingdom | 482/129 |

*Primary Examiner*—John Mulcahy
*Attorney, Agent, or Firm*—Charles E. Baxley, Esq.

[57] ABSTRACT

An exercise apparatus includes a lower bracket which clamps onto the bottom of a door and bolts which are threaded into the tower bracket and which jack the bracket upwardly against the door to prevent motion of the door. A tension spring connected to the sower bracket is connected to a cable which is guided by pulleys which are mounted on an upper bracket. The upper bracket is clamped on the top of the door. The cable is connected to a handle which enables a user to pull on the cable against the resisting force provided by the spring thereby exercising the user's muscles.

8 Claims, 4 Drawing Sheets

7
7
3
3
36
34
20
24
26
12
40
38
16
50
48
46
32
28
18
22

30
28
16
46

APPARATUS FOR EXERCISING TRICEPS MUSCLES

FIELD OF THE INVENTION

The present invention relates generally to the field of exercise equipment and more particularly to a portable apparatus for exercising triceps muscles.

BACKGROUND OF THE INVENTION

The prior art includes numerous examples of various types of exercise equipment however, there remains a need for a light-weight, portable apparatus which can be easily installed and which can be used to provide effective exercise for triceps muscles.

OBJECTS OF THE INVENTION

It is an object of the present invention to provide an apparatus for exercising the triceps which can be easily attached to a door.

Another object of the present invention is to provide an apparatus for exercising the triceps muscles which is both light in weight and easily portable.

Another object of the of the present invention which can be removably attached to a door without resorting to drilling holes or to fasteners of any kind which would mar the finish of the door.

Yet another object of the present invention is to provide an apparatus for exercising triceps muscles which includes a relatively small number of component parts which are relatively simple to manufacture resulting in reliable long-term operation and a relatively low overall cost.

The foregoing and other objects and advantages of the present invention will appear more clearly hereinafter.

In accordance with the present invention there is provided an apparatus for exercising triceps muscles which includes an upper bracket which is mounted on the top of a door and a lower bracket which is mounted on the bottom of the door.

The lower bracket includes a horizontal bolt which clamps the lower bracket onto the door and four vertical bolts which jack the lower bracket against the floor thereby preventing movement of the door during use of the apparatus. A tension spring is connected to the lower bracket and the tension spring is connected to a cable which is guided by a pair of pulleys which are mounted on the upper bracket.

The upper bracket is clamped onto the top of the door by a bolt. The cable is connected to a handle which enables a user to pull on the cable against the resisting force provided by the spring thereby exercising the user's triceps muscles.

DESCRIPTION OF THE DRAWINGS

Other important objects and advantages of the invention will be apparent from the following detailed description, taken in connection with the accompanying drawings in which.

DETAILED DESCRIPTION OF THE INVENTION

Figure 1:
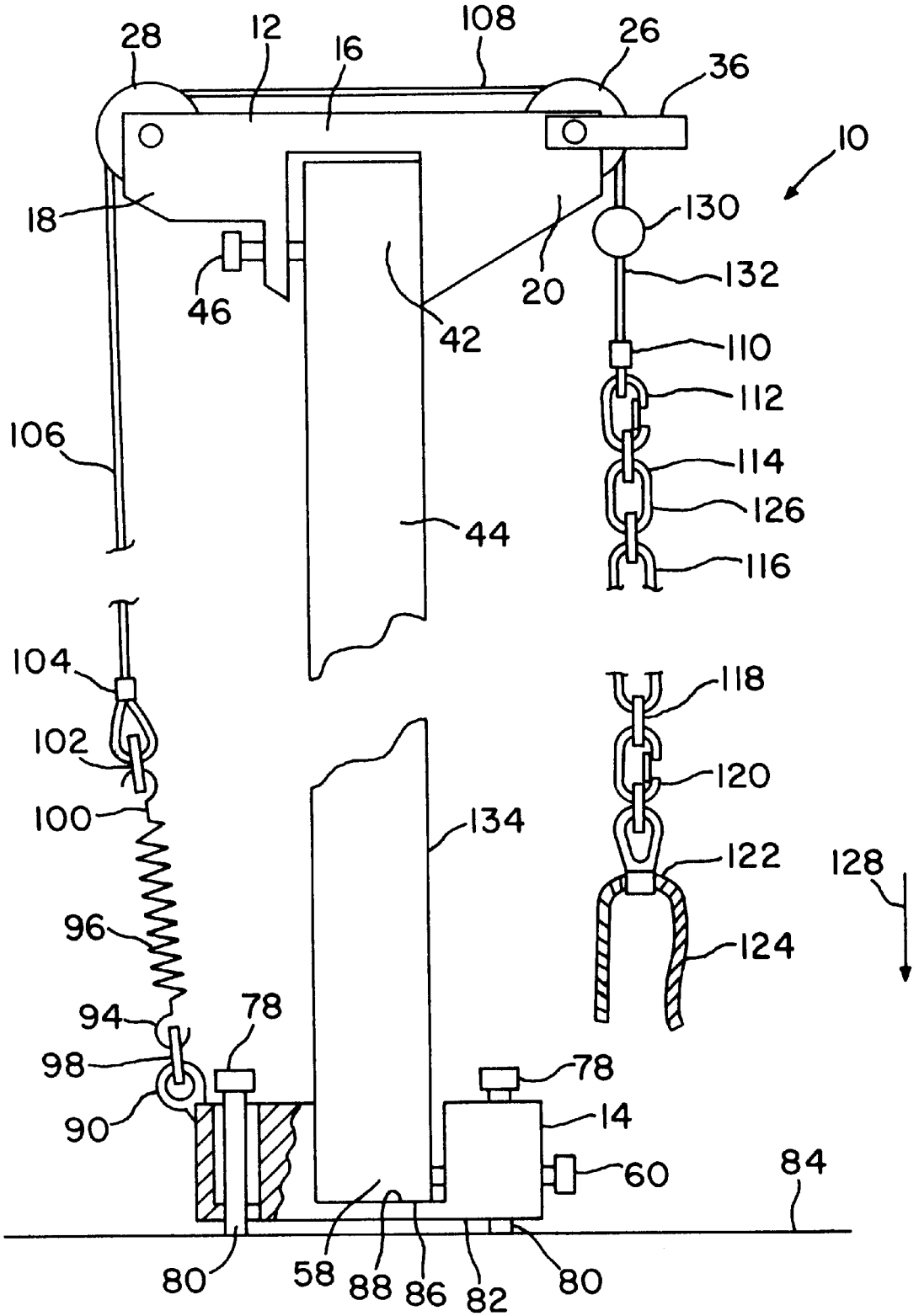
FIG. 1 is a side elevational view of an apparatus for exercising triceps muscles with the apparatus shown installed on a door and with a portion shown broken away to reveal details of internal construction.
Figure 2:
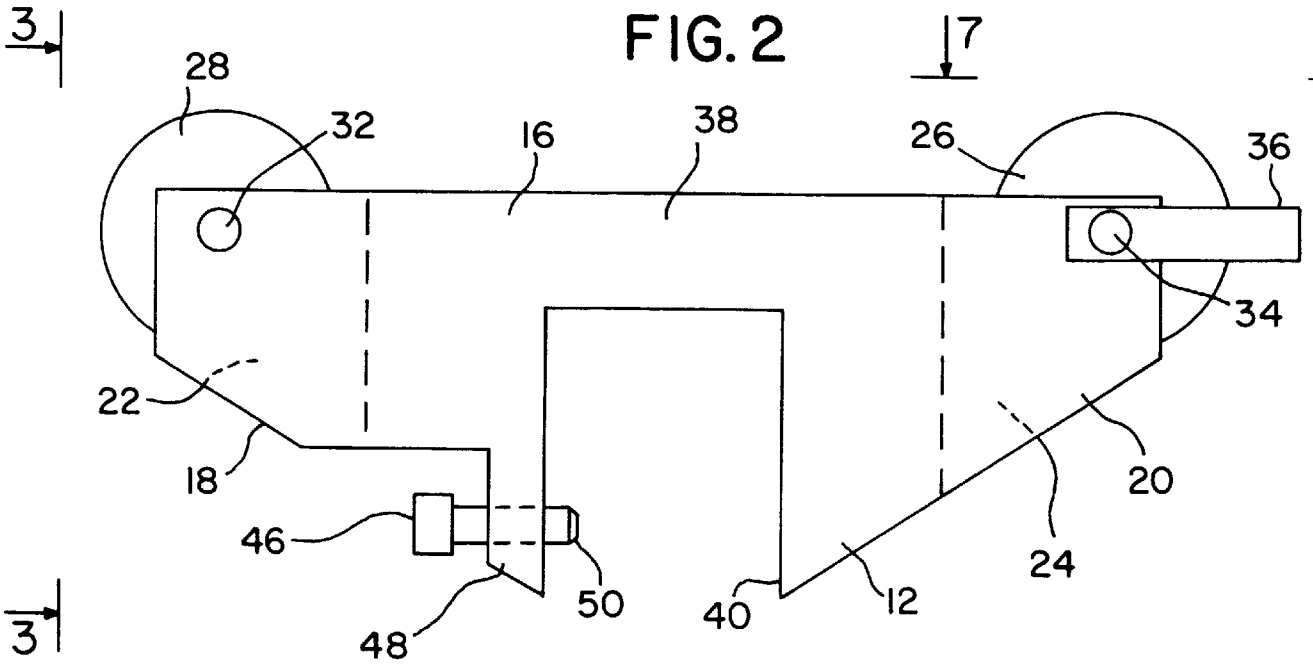
FIG. 2 is a side elevational view of the upper assembly of the apparatus of FIG. 1 with the upper bracket drawn to an enlarged scale.
Figure 3:
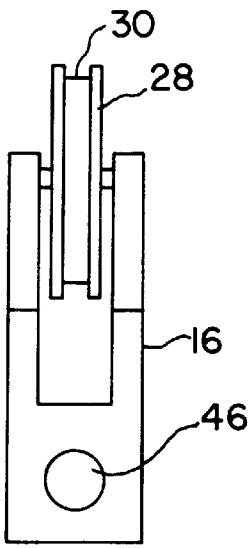
FIG. 3 is an end view of the upper bracket of FIG. 2 taken along line 3—3 of FIG. 2.

With reference to the drawings, wherein like reference numbers designate like or corresponding parts throughout, there is shown in FIGS. 1–7 an apparatus 10 for exercising triceps muscles made in accordance with the present invention.

Apparatus 10 includes an upper bracket 12 and a lower bracket 14. The upper bracket 12 includes a support plate 16 which has a first end 18 and a second end 20 each of which has a slot 22, 24 formed thereon. A pair of pulley wheels 26, 20 each having a groove 30 are rotatably mounted on axles 32, 34 which are located proximate to first and second ends 18, 20. A cable guide 36 is mounted on second end 20.

Central portion 38 of support plate 16 includes a slot 40 which is proportioned to fit loosely on the top 42 of a door 44 as is shown in FIG. 1. A bolt 46 which is threaded into a portion 48 of support plate 16 has an end 30 which projects into slot 40 thereby enabling support plate 16 to be clamped onto the top 42 of the door 44 in a secure manner.

Figure 5:
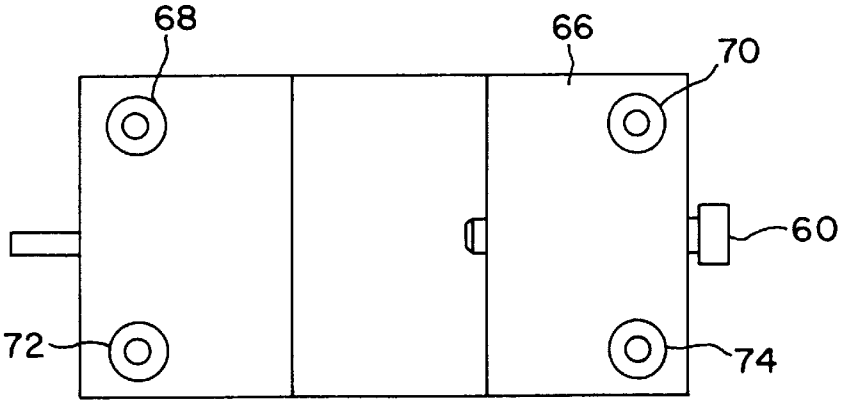
FIG. 5 is an end view of the lower bracket of FIG. 4 taken along line 5—5 of FIG. 4.
Figure 4:
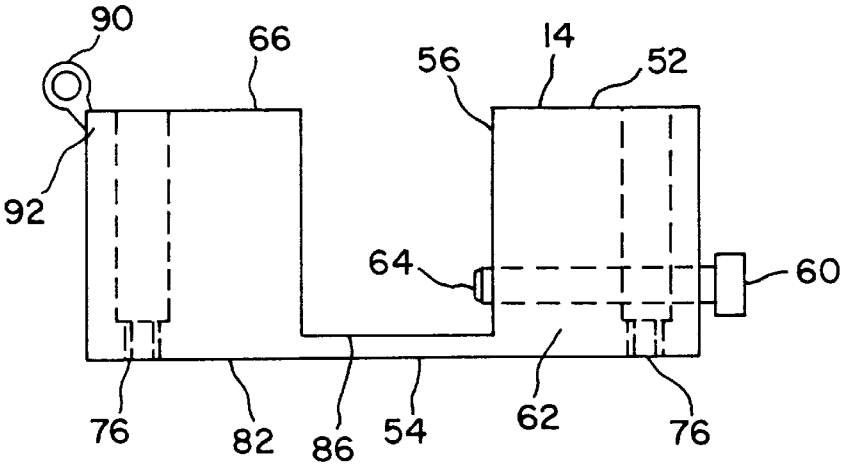
FIG. 4 is a side elevation view of the lower bracket of the apparatus of FIG. 1.
Figure 7:
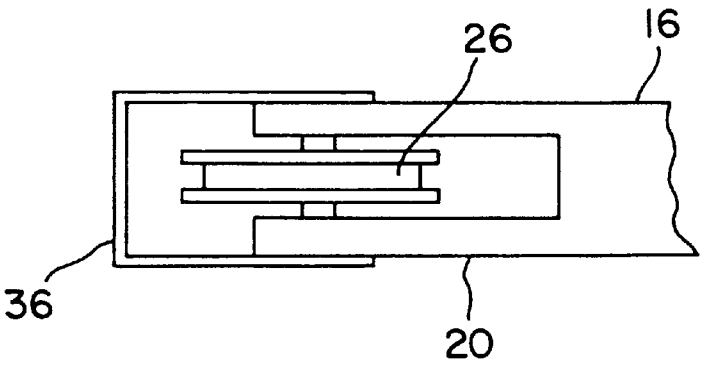
FIG. 7 is a fragmentary top view taken along line 7—7 of FIG. 2.

Lower bracket 14 is best shown in FIGS. 4 and 5 and includes a generally rectangular block 52. Central portion 54 of block 52 includes a slot 56 which is proportioned to fit loosely onto the bottom 58 of the door 44. A generally horizontal bolt 60 which is threaded into portion 62 of block 52 has an and 64 which projects into slot 56 thereby enabling block 52 to be clamped onto the bottom 58 of the door 44 in a secure manner.

Upper surface 66 of block 14 has four counterbored holes 68,70,72,74, the lower portion 76 of each of which is threaded. As is shown is FIG. 1, a bolt 76 is threaded into each of the counterbored holes 68,70,72,74 and the ends 80 of the bolts 78 project beyond the lower surface 82 of block 14. Rotation of the bolts 78 caused the ends 80 of the bolts 78 to bear against the floor 84 below door 44 and lifts block 14 causing surface 86 of slot 56 to bear against lower surface 88 of door 44 thereby preventing door 44 from moving. An eye-bolt 90 is threaded into upper edge 92 of block 14.

As is shown in FIG. 1, first end 94 of tension spring 96 is hooked onto a snap-ring 98 which is mounted on eyebolt 90. Second end 100 of tension spring 96 is hooked onto a snap-ring 102 which is connected to first end 104 of cable 106. Intermediate portion 108 of cable 106 passes over pulleys 26,28 and through cable guide 36 and second end 110 of cable 106 is attached to snap-ring 112 which is mounted on the first end 114 of adjustment chain 116. Second end 118 of adjustment chain 116 is connected to snap-ring 120 which is also connected to central portion 122 of rope handle 124. Snap-rings 112, 120 can be selectively connected to any desired link 126 of adjustment chain 116 thereby adjusting the effective length of adjustment chain 116.

During use, a user grasps the rope handle 124 and pulls the handle 124 downwardly in the direction generally shown by the arrow 128 in FIG. 1. Pulling on handle 12, stretches tension spring 96, thereby providing resistance and effectively exercising the user's triceps muscles. When the rope 124 handle is released, upward motion of the cable 106 is limited by a stop ball 130 which is attached to portion 132 contacting the U-shaped cable guide 36.

While only a single exercise has been described above, it is clear that the apparatus 10 of the present invention may be used to perform a broad variety of exercises. The user may perform exercises using one hand or both hands while facing surface 134 door 44 and also while facing away from surface 134 of door 44.

Figure 6:
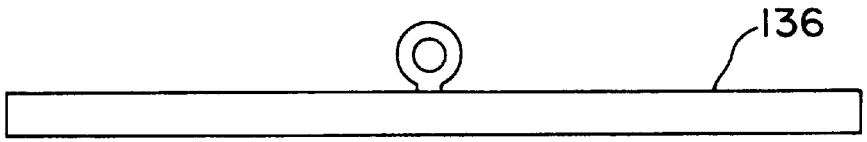
FIG. 6 is an elevational view of a handle bar for use with the apparatus of FIG. 1.

Alternatively, the rope handle 124, may be removed using snap-ring 120 and a handle bar 136, which is shown in FIG. 6, may be installed. The snap-rings 98, 102, 112, 120 facilitate the rapid disassembly of the various components of the apparatus 10 for purposes of storage or travel.

The upper and lower brackets 14, 16 are preferably made of plastic thereby combining the requisite strength with light overall weight which facilitates use of the apparatus 10 during travel. The brackets 14, 16 can be easily installed onto a door 44 without a need for drilling holes or damaging the door.

The foregoing specific embodiment of the present invention as set forth in the specification herein is for illustrative purposes only. Various deviations and modifications can be made within the spirit and scope of this invention, without departing from the main theme thereof.

I claim:

1. An apparatus for exercising triceps muscles for use on a door comprising:

a plate member, with said plate member having a first end, a second end and an intermediate portion;

clamp means, disposed on said intermediate portion of said plate member, for mounting said plate member on the top of a door;

a pair of pulleys with said pulleys rotationally mounted, one each, on said first end and on said second end of said plate member;

a block member;

mounting means disposed on said block member for mounting said block member on the bottom of a door;

a tension spring having a first end and a second end, with said first end of said tension spring attached to said block member;

a flexible cable member with said flexible cable member having a first end, an intermediate portion and a second end, with said first end of said flexible cable member attached to said second end of said tension spring and with said intermediate portion of said flexible cable member supported by said pair of pulleys; and a handle member, with said handle member attached to said second end of said flexible cable member, wherein said mounting means disposed on said block member for mounting said block member on the bottom of a door comprises:

a slot portion formed on said block member, and a bolt, with said bolt threaded into said block member and with said bolt having an end projecting into said slot portion formed on said block member for the purpose of bearing against the bottom of a door, and wherein said block member further comprises jacking means for lifting said block against the bottom of a door.

2. An apparatus for exercising triceps muscles as claimed in claim 1, wherein said clamp means for mounting said plate member on the top of a door comprises:

a slot portion formed on said intermediate portion of said plate member, and a bolt, with said bolt disposed threaded into said plate member and with said bolt having an and protecting into said slot potion, formed on said intermediate portion of said plate member.

3. An apparatus for exercising triceps muscles as claimed in claim 1, wherein said handle member comprises a rope handle.

4. An apparatus for exercising triceps muscles as claimed in claim 1, wherein said handle member comprises a bar member.

5. An apparatus for exercising triceps muscles as claimed in claim 1, wherein said jacking means for lifting said block member comprises a plurality of bolts threaded into said block member with said bolts disposed on opposite sides of a door.

6. An apparatus for exercising triceps muscles as claimed in claim 1, further comprising a cable guide mounted on one of said pulleys.

7. An apparatus for exercising triceps muscles as claimed in claim 1, further comprising:

a first snap-ring removably attached to said second end of said flexible cable member;

a chain having a first end and a second end with said first end attached to said first snap-ring;

a second snap-ring attached to said second end of said chain and with said handle member attached to said second snap-ring.

8. An apparatus for exercising triceps muscles as claimed in claim 1, further comprising;

a snap-ring connecting said first end of said flexible cable member and said second end of said tension spring.

* * * * *